US010632348B2

(12) United States Patent
Kultala et al.

(10) Patent No.: US 10,632,348 B2
(45) Date of Patent: Apr. 28, 2020

(54) GOLF CLUB SHAFT ASSEMBLY

(71) Applicant: KARSTEN MANUFACTURING CORPORATION, Phoenix, AZ (US)

(72) Inventors: David S. Kultala, Phoenix, AZ (US); Ryan M. Stokke, Anthem, AZ (US); Martin R. Jertson, Cave Creek, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 15/446,502

(22) Filed: Mar. 1, 2017

(65) Prior Publication Data

US 2017/0252611 A1 Sep. 7, 2017

Related U.S. Application Data

(60) Provisional application No. 62/302,383, filed on Mar. 2, 2016.

(51) Int. Cl.
*A63B 53/04* (2015.01)
*A63B 53/02* (2015.01)

(52) U.S. Cl.
CPC ..... *A63B 53/02* (2013.01)

(58) Field of Classification Search
CPC ..... A63B 53/02
See application file for complete search history.

(56) References Cited

U.S. PATENT DOCUMENTS 5,454,563 A 10/1995 Nagamoto
5,643,105 A 7/1997 Niswander
6,368,230 B1 4/2002 Helmstetter
8,226,496 B2 7/2012 Galloway
8,641,554 B1 2/2014 Hocknell
8,852,022 B2 10/2014 DeShiell
9,033,821 B2 5/2015 Beach
9,144,719 B1 9/2015 Vrska
9,144,720 B1 9/2015 Vrska
9,168,426 B2 10/2015 Solheim
(Continued)

FOREIGN PATENT DOCUMENTS

GB 2105630 A * 3/1983 ..... B25G 3/04
GB 2144042 A 2/1985

OTHER PUBLICATIONS

Club-conex Interchangeable Shaft Adapters—Dsa, Source: https://www.banggolf.com/prodgroup.asp?id=DSA , Date Accessed: Oct. 29, 2015.

*Primary Examiner* — John E Simms, Jr.

(57) ABSTRACT

Embodiments of golf clubs with coupling mechanisms are presented herein. In some embodiments, a golf club comprises a shaft having a shaft bore and a first end, and a club head having a coupling mechanism, the coupling mechanism including a hosel, an insert configured to be positioned within the hosel, the insert including a top end, a bottom end, an insert bore configured to receive the first end of the shaft, the insert bore having a bottom surface and an insert bore depth measured from the bottom surface to the top end of the insert, and a reinforcement member extending from the bottom surface of the insert bore, the reinforcement member configured to be positioned within the shaft bore to reinforce the coupling mechanism.

18 Claims, 4 Drawing Sheets

(56) References Cited

U.S. PATENT DOCUMENTS

| | | | | |
|---|---|---|---|---|
| 2006/0264266 | A1* | 11/2006 | Jung | A63B 53/00 473/282 |
| 2006/0287125 | A1* | 12/2006 | Hocknell | A63B 53/00 473/309 |
| 2007/0026960 | A1 | 2/2007 | Butler | |
| 2007/0173344 | A1 | 7/2007 | Burch | |
| 2010/0210374 | A1* | 8/2010 | Galloway | A63B 53/02 473/307 |
| 2014/0357398 | A1* | 12/2014 | Yamamoto | A63B 53/12 473/305 |
| 2015/0297957 | A1 | 10/2015 | Sander | |

* cited by examiner

GOLF CLUB SHAFT ASSEMBLY

CROSS REFERENCE TO RELATED APPLICATIONS

This claims the benefit of U.S. Provisional Patent Application No. 62/302,383, filed on Mar. 2, 2016, the content of which is fully incorporated herein by reference.

FIELD OF INVENTION

The present disclosure relates generally to sports equipment, and relates, more particularly, to golf coupling mechanisms and related methods.

BACKGROUND

Currently, golf club heads are coupled to golf club shafts using a variety of mechanisms. Coupling mechanisms can vary for different types of club heads. For example, many putter type club heads are coupled to shafts by a bore in the club head or a hosel configured to receive the shaft. Further, many iron and wood type club heads (e.g. fairway woods, hybrids, and drivers) are coupled to shafts using a hosel and a coupling mechanism.

The impact force of a club head with a golf ball imparts high stresses on golf club coupling mechanisms, and in particular on coupling mechanisms of golf club heads designed for high swing speeds. Accordingly, coupling mechanisms are typically designed to withstand significant stresses. Many current coupling mechanisms designed to withstand high stresses have increased weight and/or sub-optimal mass distribution characteristics, which can adversely affect club head performance. Further, current coupling mechanisms that are designed to maintain specific weight and mass distribution characteristics have reduced thresholds of stress and may fail at high impact speeds or after repeated use due to cyclic loading of the coupling mechanism. Accordingly, there is a need in the art for a coupling mechanism having increased strength, while maintaining or reducing weight to achieve desired mass distribution characteristics such that specific performance characteristics of the golf club can be achieved.

Figure 1:
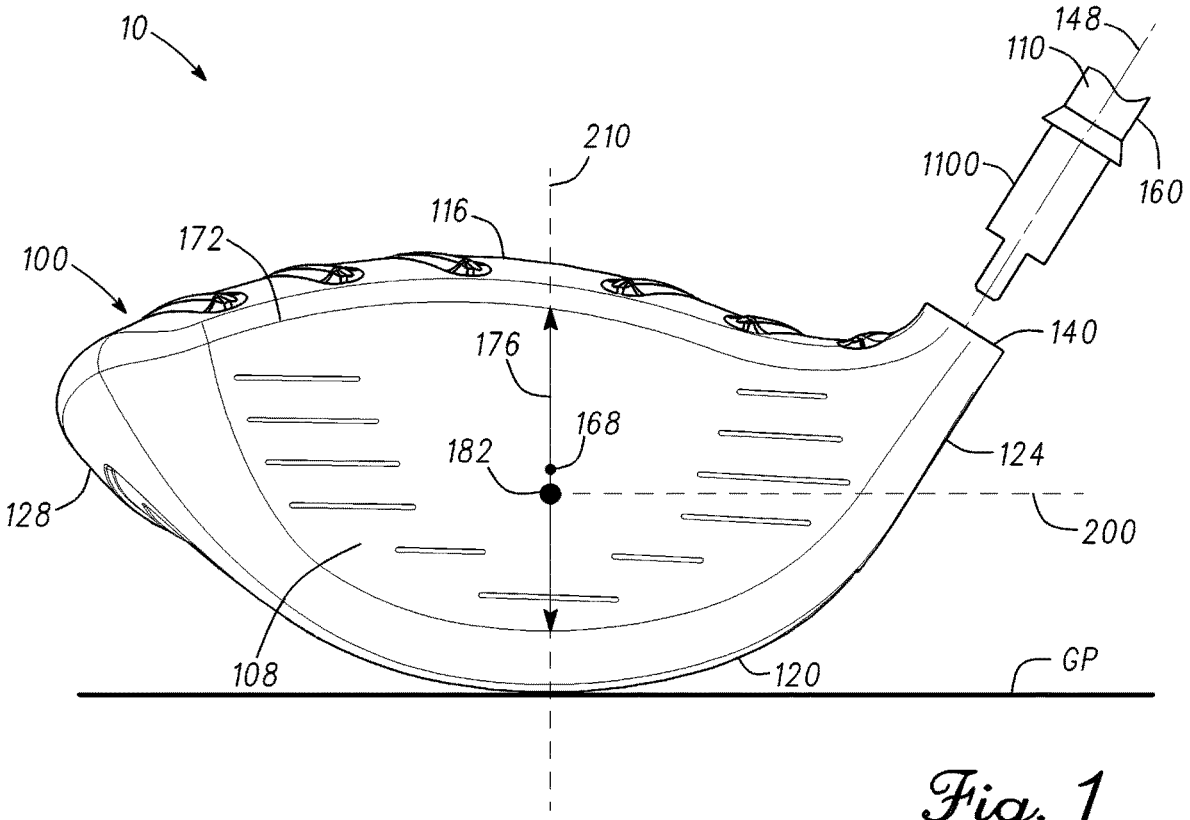
FIG. 1 illustrates a front view of a golf club according to an embodiment.

Other aspects of the disclosure will become apparent by consideration of the detailed description and accompanying drawings.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures are not necessarily drawn to scale. For example, the dimensions of some of the elements in the figures may be exaggerated relative to other elements to help improve understanding of embodiments of the present disclosure. The same reference numerals in different figures denote the same elements.

DETAILED DESCRIPTION

Described herein is a golf club having a reinforced coupling mechanism between the golf club head and the shaft. The coupling mechanism includes an insert configured to be positioned within a hosel of the club head, the insert having a top end, a bottom end, an insert bore, and a reinforcement member extending from a bottom surface of the insert bore. The insert bore is configured to receive the shaft such that the reinforcement member extends into a shaft bore, past the top end of the insert to reinforce the coupling mechanism. In many embodiments, increased reinforcement of the coupling mechanism due to the reinforcement member can allow the shaft to be lighter in weight while maintaining durability. Further, reduced shaft weight can result in improved swing weight characteristics and balance points of the golf club, and/or improved mass distribution characteristics and optimized center of gravity positions of the club head.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways.

FIG. 1 illustrates a front perspective view of a golf club 10 according to one example of the present disclosure. The golf club 10 includes a club head 100, a shaft 110, and a coupling mechanism 1000 (FIG. 3) configured to couple the club head 100 to the shaft 110 to form the golf club 10. In the illustrated embodiment, the golf club 10 is shown as a driver type golf club.

In other embodiments, the golf club 10 can be any type of golf club, such as a wood-type club head (e.g. a driver, a fairway wood, or a hybrid), an iron-type club head (e.g. a iron or a wedge), or a putter-type club head.

Figure 2:
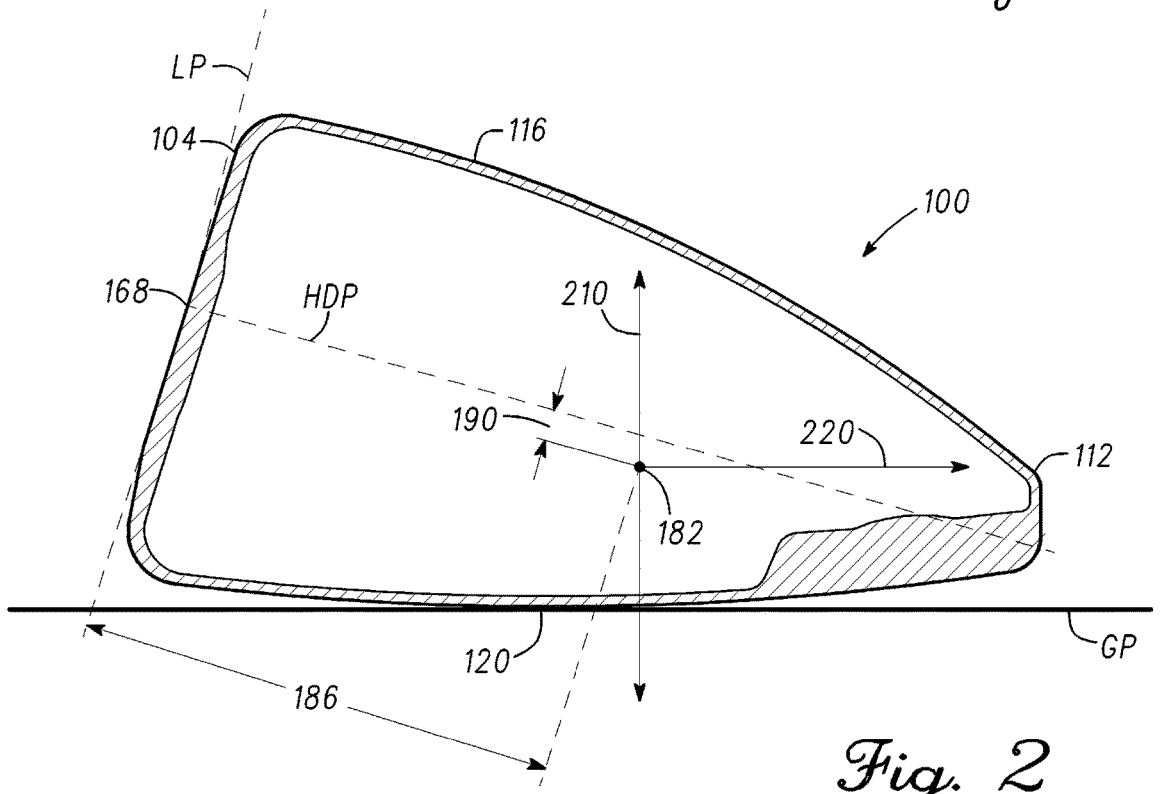
FIG. 2 illustrates a side cross sectional view of the golf club head of FIG. 1.
Figure 3:
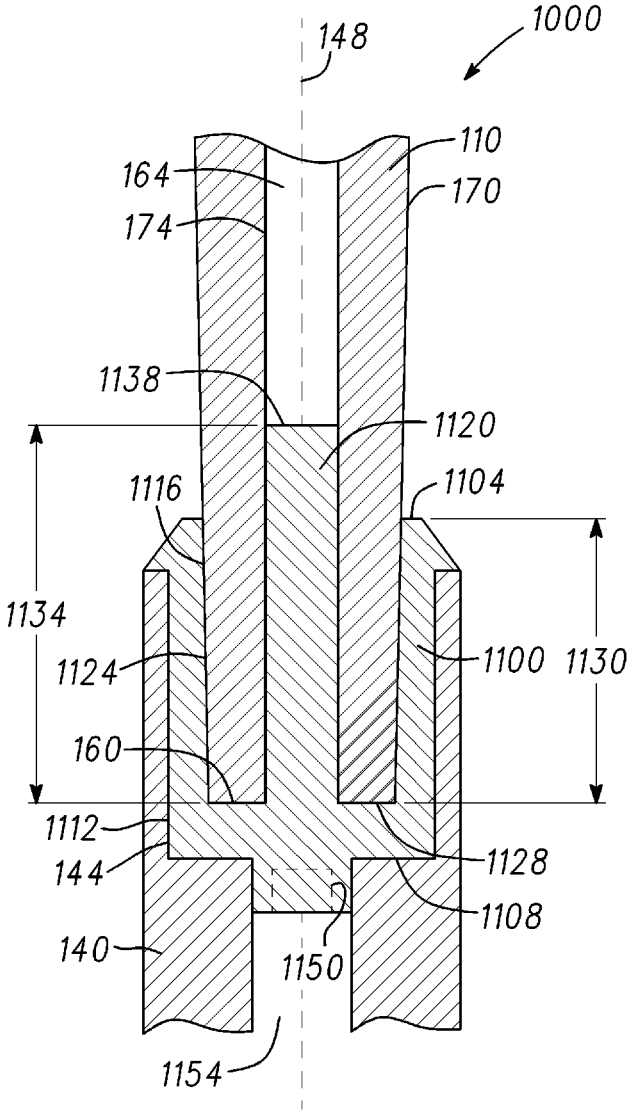
FIG. 3 illustrates an enlarged cross sectional view of the coupling mechanism of the golf club head of FIG. 1 engaged with a golf club shaft.

Referring to FIGS. 1-3, the club head 100 includes a front end 104 with a strikeface 108, a rear end 112 opposite the front end 104, a top end 116, a bottom end 120 opposite the top end 116, a heel portion 124, and a toe portion 128 opposite the heel portion 124. The club head 100 further includes a hosel 140 positioned near the heel portion 124 of the club head 100. The hosel 140 includes a hosel bore 144 and a hosel axis 148 extending centrally through the hosel bore 144. The shaft 110 of the golf club 10 includes an outer surface 170, an inner surface 174, a first end 160 configured to couple to the club head 100, a second end (not shown) configured to receive a grip (not shown), and a shaft bore 164.

Referring to FIG. 1, the strikeface 108 of the club head 100 includes a strikeface centerpoint 168, a strikeface perimeter 172, and a face height 176. The strikeface centerpoint 168 is located at a geometric centerpoint of the strikeface perimeter 172 in the present example, and at a midpoint of face height 176. In the same or other examples, the strikeface centerpoint 168 can be located in accordance with the definition of a golf governing body such as the United States Golf Association (USGA). For example, the strikeface centerpoint 168 can be determined in accordance with Section 6.1 of the USGA's Procedure for Measuring the Flexibility of a Golf Clubhead (USGA-TPX3004, Rev. 1.0.0, May 1, 2008) (available at http://www.usga.org/equipment/testing/protocols/Procedure-For-Measuring-The-Flexibility-Of-A-Golf-Club-Head/) (the "Flexibility Procedure").

FIGS. 1-2 present the club head 100 at an address position relative to a ground plane GP, where the hosel axis 148 is positioned at a 60-degree angle to the ground plane GP with respect to a front view of the club head 100 (FIG. 1), and where the hosel axis 148 is substantially orthogonal to the ground plane GP with respect to a side view of the golf club head 100.

Referring to FIGS. 1-2, the club head 100 further includes a loft plane LP positioned tangent to the strikeface centerpoint 168, and a head center of gravity (CG) 182. The head CG 182 is positioned at a CG depth 186 measured as the perpendicular distance from the head CG 182 to the loft plane LP. The head CG 182 is further positioned at a CG height 190 measured as the perpendicular distance between the head CG 182 and a head depth plane HDP, where the head depth plane HDP extends through the strikeface centerpoint 168 perpendicular to the loft plane LP.

Further referring to FIGS. 1-2, the head CG 182 defines an origin of a coordinate system having an x-axis 200, a y-axis 210, and a z-axis 220. The x-axis 200 extends through the head CG 182 in a direction from the heel portion 124 to the toe portion 128 of the club head 100, parallel to the ground plane GP. The y-axis 210 extends through the head CG 182 in a direction from the top end 116 to the bottom end 120 of the club head 100, perpendicular to the x-axis 200 and the ground plane GP. The z-axis 220 extends through the head CG 182 in a direction from the front end 104 to the rear end 112 of the club head 100, parallel to the ground plane GP and perpendicular to the x-axis 200 and the y-axis 210.

Referring to FIG. 3, the coupling mechanism 1000 of the club head 100 includes the hosel 140 and an insert 1100. The insert 1100 includes a top end 1104, a bottom end 1108 opposite the top end 1104, an outer surface 1112, an inner surface 1116, and a reinforcement member 1120. The insert 1100 further includes an insert bore 1124 having a bottom surface 1128 and an insert bore depth 1130 measured from the bottom surface 1128 to the top end 1104 of the insert 1100. The reinforcement member 1120 extends from the bottom surface 1128 of the insert bore 1124 and includes a reinforcement height 1134 measured from the bottom surface 1128 of the insert bore 1124 to a top end 1138 of the reinforcement member 1120.

Referring to FIG. 3, the reinforcement height 1134 is greater than the insert bore depth 1130. For example, in many embodiments, the reinforcement height 1134 can be 1.0-2.5 times greater than the insert bore depth 1130. For further example, the reinforcement height 1134 can be 1.1, 1.2, 1.3, 1.4, 1.5, 1.6, 1.7, 1.8, 1.9, 2.0, 2.1, 2.2, 2.3, 2.4, or 2.5 times the insert bore depth 1130. Further, in some embodiments, the reinforcement height 1134 can be greater than or equal to 1.0 times, greater than or equal to 1.25 times, or greater than or equal to 1.5 times, greater than or equal to 1.75 times, greater than or equal to 2.0 times, greater than or equal to 2.25 times, or greater than or equal to 2.5 times the insert bore depth 1130.

Referring to FIG. 3, in many embodiments, the insert bore depth 1130 can be 0.25-1.5 inches. For example, in some embodiments, the insert bore depth 1130 can be 0.25 inches, 0.50 inches, 0.75 inches, 1.0 inches, 1.25 inches, or 1.5 inches. For further example, in some embodiments, the insert bore depth 1130 can be less than or equal to 1.5 inches, less than or equal to 1.25 inches, less than or equal to 1.0 inches, or less than or equal to 0.5 inches. In other embodiments, the insert bore depth 1130 can range from 0.25-1.0 inches, 0.25-0.5 inches, 0.5-1.25 inches, or 0.75-2.0 inches.

Referring to FIG. 3, the reinforcement height 1134 can be 0.5-2.5 inches. For example, in some embodiments, the reinforcement height 1134 can be 0.5 inches, 0.75 inches, 1.0 inches, 1.25 inches, 1.5 inches, 1.75 inches, 2.0 inches, or 2.25 inches. For further example, in some embodiments, the reinforcement height 1134 can be greater than or equal to 0.5 inches, greater than or equal to 0.75 inches, greater than or equal to 1.0 inches, greater than or equal to 1.25 inches, greater than or equal to 1.5 inches, greater than or equal to 1.75 inches, greater than or equal to 2.0 inches. In other embodiments, the reinforcement height 1134 can range from 0.5-1.0 inches, 0.75-1.5 inches, 1.0-2.0 inches, 1.0-2.5 inches, or 1.25-2.5 inches.

Referring to FIG. 3, in the illustrated embodiment, the reinforcement member 1120 has a substantially circular cross-sectional shape corresponding to the cross-sectional shape of the shaft bore 164. Further, in the illustrated embodiment, the reinforcement member 1120 has a constant diameter. In other embodiments, the reinforcement member 1120 can have any cross-sectional shape, such as triangular, square, rectangular, star, oval, polygonal, or any shape with at least one curved surface. Further, in other embodiments, the reinforcement member 1120 can have a cross sectional shape with one or more dimensions that vary along the length of the reinforcement member 1120. For example, in other embodiments, the diameter of the reinforcement member 1120 can decrease in a direction toward the top end 1104 of the insert 1100.

In some embodiments, the reinforcement member 1120 can include circumferential or longitudinal ribs or flanges to engage shafts of differing or varying bore diameters. In these or other embodiments, the reinforcement member 1120 can include circumferential or longitudinal ribs or flanges to increase reinforcement member bonding area, as discussed in further detail below. For example, in some embodiments, the reinforcement member 1120 can include 2, 3, 4, 5, or any other number of ribs. Further, the ribs can extend along the entire length of the reinforcement member 1120, or the ribs can extend along a portion of the length of the reinforcement member 1120.

Referring to FIG. 3, in the illustrated embodiments, the reinforcement member 1120 is integrally formed with the insert 1100. Specifically, in the illustrated embodiments, the reinforcement member 1120 is integrally coupled to the bottom surface 1128 of the insert bore 1124. Further, in the illustrated embodiment, the insert 1100 and reinforcement member 1120 comprise the same material. In one embodiment, the insert 1100 and reinforcement member 1120 can comprise a material (e.g. aluminum or aluminum alloy) having a specific gravity of 2.7. In other embodiments, the insert 1100 and reinforcement member 1120 can comprise any material having a specific gravity greater than 2.0, greater than 2.1, greater than 2.2, greater than 2.3, greater than 2.4, greater than 2.5, greater than 2.6, greater than 2.7, greater than 2.8, greater than 2.9, or greater than 3.0. For example, the insert 1100 and reinforcement member 1120 can be made of aluminum, titanium, steel, other metals, metal alloys, plastic, or composite materials. Further, in other embodiments, the reinforcement member 1120 can be formed separately and subsequently can be integrally coupled to the insert 1100. In these or other embodiments, the reinforcement member 1120 can be made of a different material than the insert 1100. Further, in these or other embodiments, the reinforcement member 1120 can have a first specific gravity and the remainder of the insert 1100 can have a second specific gravity, different than the first specific gravity.

In many embodiments, the insert 1100 having the integrally formed reinforcement member 1120 allows increased reinforcement strength to the coupling mechanism 1000 compared to an insert having a reinforcement member separately or removably attached to the insert. Integrally forming the reinforcement member 1120 with the insert 1100 allows impact stresses to be fully distributed or dissipated through the insert 1100, thereby preventing the stress from being localized as a stress riser to the junction between the reinforcement member 1120 and the insert 1100.

Referring to FIG. 3, the insert 1100 further includes a contact surface area. The contact surface area includes the contact area of the insert 1100 with the outer and inner surfaces of the shaft 110. For example, in the illustrated embodiment, the contact surface area includes the contact area of the inner surface 1116 of the insert 1100 with the outer surface 170 of the shaft 110, the contact area of the bottom surface 1128 of the insert 1100 with the first end 160 of the shaft 110, and the contact area of the reinforcement member 1120 with the inner surface 174 of the shaft 110. For further example, in the illustrated embodiment, the contact surface area includes the area of the inner surface 1116 of the insert 1100, the bottom surface 1128 of the insert 1100, and the reinforcement member 1120.

In the illustrated embodiment, the contact surface area can range from 1.25 $in^2$-3 $in^2$. For example, in some embodiments, the contact surface area can be 1.25 $in^2$, 1.5 $in^2$, 1.75 $in^2$, 2.0 $in^2$, 2.25 $in^2$, 2.5 $in^2$, 2.75 $in^2$, or 3.0 $in^2$. Further, in some embodiments, the contact surface area can be greater than 1.25 $in^2$, greater than 1.5 $in^2$, greater than 1.75 $in^2$, greater than 2.0 $in^2$, greater than 2.25 $in^2$, greater than 2.5 $in^2$, or greater than 2.75 $in^2$. In other embodiments, the contact surface area can range from 1.5-3.0 $in^2$, 1.75-3.0 $in^2$, 1.5-2.5 $in^2$, or 2.0-3.0 $in^2$.

The coupling mechanism 1000 is configured to couple the club head 100 and the shaft 110 using the insert 1100. Referring to FIG. 3, in the illustrated embodiment, the insert 1100 includes a threaded inner surface 1150 positioned near the bottom end 1108. When assembled, the insert 1100 is positioned within the hosel 140 and is secured to the hosel 140 using a threaded fastener (not shown) positioned through a bore or recess 1154 in the sole portion of the club head 100 and into the threaded inner surface 1150 of the insert 1100. In other embodiments, the insert 1100 can be coupled to the hosel 140 without the use of a threaded inner surface 1150 and corresponding threaded fastener. For example, in other embodiments, the insert 1100 can be secured within the hosel 140 using an adhesive, a pin and slot mechanism, a mechanical press-fit, a taper lock mechanism, or any other mechanism capable of permanently or removably securing the insert 1100 within the hosel 140.

In many embodiments, the insert 1100 can be repositioned in the hosel 140 to change the loft angle and/or lie angle of the club head 100, similar to the inserts described in U.S. Provisional Patent Application No. 62/107,240, entitled "Golf Clubs with Hosel Inserts and RelatedMethods". In other embodiments, other mechanisms can be employed to adjust the loft and/or lie angle of the club head 100.

When assembled, the first end 160 of the shaft 110 is positioned in the insert bore 1124 such that the reinforcement member 1120 extends into the shaft bore 164. In many embodiments, the reinforcement member 1120 can have a diameter corresponding to or slightly less than the diameter of the shaft bore 164 to allow the reinforcement member 1120 to maintain contact with the inner surface of the shaft 110. In many embodiments, the reinforcement member 1120 extends past the top end 1104 of the insert 1100 when assembled. Accordingly, the reinforcement member 1120 provides increased support to the first end 160 of the shaft 110, thereby allowing the shaft 110 to withstand increased force and impacts. The reinforcement member 1120 provides increased support to the shaft 110 by distributing impact stress to a greater area of the first end 160 of the shaft 110 during impact to prevent the stress from being localized at a portion of the shaft 110 adjacent to the top end 1104 of the insert 1100.

In many embodiments, the shaft 110 is secured to the insert 1100 using an adhesive, such as epoxy or any material capable of bonding the first end 160 of the shaft 110 to the insert 1100. In many embodiments, the adhesive is positioned on the entirety of the contact surface area. In these embodiments, the bonding area is the same as the contact surface area of the insert 1100 and the shaft 110.

In other embodiments, the shaft 110 can be secured to the insert 1100 using an adhesive positioned on portions of the contact surface area between the insert 1100 and the shaft 110. For example, the adhesive can be positioned on at least one of: the contact area of the inner surface 1116 of the insert 1100 with the outer surface 170 of the shaft 110, the contact area of the bottom surface 1128 of the insert 1100 with the first end 160 of the shaft 110, or the contact area of the reinforcement member 1120 with the inner surface 174 of the shaft 110. In these embodiments, the bonding area is less than the contact surface area of the insert 1100 and the shaft 110. In other embodiments still, the shaft 110 can be mechanically secured to the insert 1100 (e.g. through a mechanical press-fit, a taper lock mechanism, a pin and slot, etc.), without the use of adhesive.

Figure 4A:
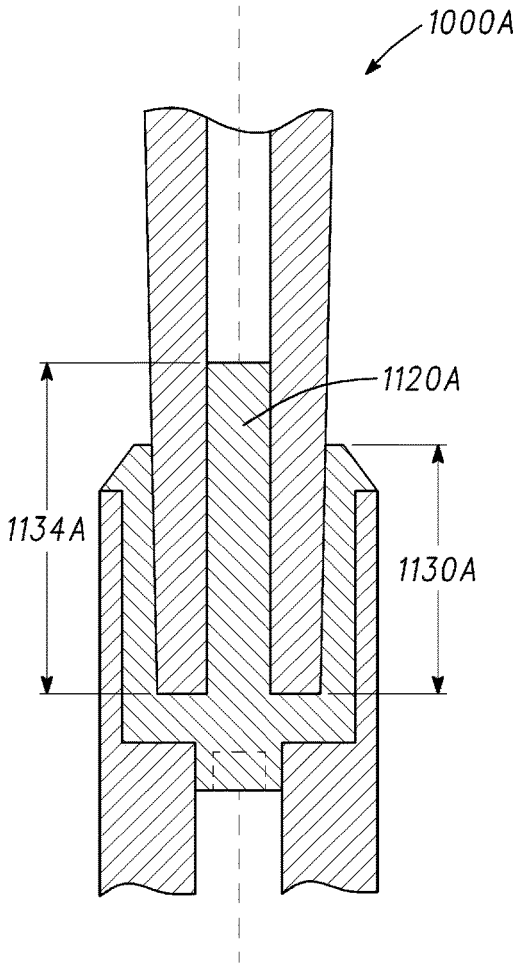
FIG. 4A illustrates an enlarged cross sectional view of one exemplary coupling mechanism according to the embodiment of FIG. 3.

FIG. 4A illustrates an exemplary coupling mechanism 1000A according to an embodiment. Coupling mechanism 1000A is an exemplary coupling mechanism similar to the embodiment of coupling mechanism 1000. The coupling mechanism 1000A having the reinforcement member 1120A has increased contact surface area between the insert 1100 and the shaft 110 compared to a coupling mechanism having similar dimensions without a reinforcement member.

Referring to FIG. 4A, according to one example, the exemplary coupling mechanism 1000A has a reinforcement height 1134A of 1.5 inches, an insert bore depth 1130A of 1.0 inch, a ratio of the reinforcement height 1134A to the insert bore depth 1130A of 1.5, and a contact surface area of 2.23 $in^2$. Conversely, the contact surface area of a coupling mechanism having similar dimensions without the reinforcement member is 1.03 $in^2$. Accordingly, the exemplary coupling mechanism 1000A has an increased contact surface area between the insert 1100 and the shaft 110 compared to a coupling mechanism having similar dimensions without a reinforcement member. Specifically, the exemplary coupling mechanism 1000A has 2.2 times greater contact surface area than a coupling mechanism having similar dimensions without a reinforcement member. In other embodiments, the coupling mechanism 1000 having the reinforcement member 1120 can result in an increase in contact surface area of up to 1.5 times, 2.0 times, 2.5 times, or 3.0 times the contact surface area of a coupling mechanism having similar dimensions without a reinforcement member. While specific dimensions are disclosed according to the exemplary coupling mechanism 1000A, other examples can exist with varying dimensions while maintaining similar relations.

Figure 4B:
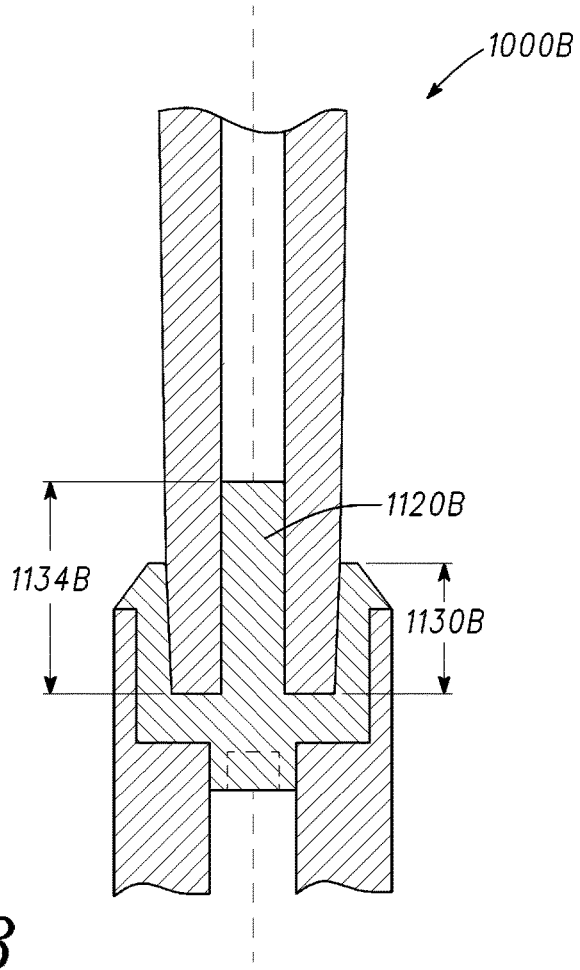
FIG. 4B illustrates an enlarged cross sectional view of another exemplary coupling mechanism according to the embodiment of FIG. 3.

FIG. 4B illustrates an exemplary coupling mechanism 1000B according to an embodiment. Coupling mechanism 1000B is an exemplary coupling mechanism similar to the embodiment of coupling mechanism 1000. The coupling mechanism 1000B having the reinforcement member 1120B can have reduced insert bore depth 1130B while maintaining or increasing contact surface area between the insert 1100 and the shaft 110, compared to a similar coupling mechanism having a greater insert bore depth without a reinforcement member.

Referring to FIG. 4B, according to one example, the exemplary coupling mechanism 1000B has a reinforcement height 1134B of 1.0 inch, an insert bore depth 1130B of 0.5 inches, a ratio of the reinforcement height 1134B to the insert bore depth 1130B of 2.0, and a contact surface area of 1.31 $in^2$. Conversely, the contact surface area of a coupling mechanism without a reinforcement member and with an insert bore depth of 1.0 inch is 1.03 $in^2$. Accordingly, in some embodiments, the coupling mechanism 1000B can have increased contact surface area compared to a coupling mechanism with a greater insert bore depth and without a reinforcement member. Further, in some embodiments, the coupling mechanism 1000B can have reduced insert bore depth 1130B while maintaining or increasing contact surface area compared to a coupling mechanism without a reinforcement member. For example, in the illustrated embodiment, the coupling mechanism 1000B having the reinforcement member 1120 has a 50% reduction in insert bore depth 1130B while maintaining or increasing contact surface area compared to a coupling mechanism without a reinforcement member. In other embodiments, the coupling mechanism 1000B can have a reduction in insert bore depth 1103B of up to 50%, up to 60%, up to 70%, or up to 80% while maintaining or increasing contact surface area compared to a coupling mechanism without a reinforcement member. While specific dimensions are disclosed according to the exemplary coupling mechanism 1000B, other examples can exist with varying dimensions while maintaining similar relations.

In many embodiments, increased contact surface area of the coupling mechanism 1000 (e.g. 1000A or 1000B) due to the reinforcement member 1120 results in increased strength of the coupling mechanism 1000. Increased strength of the coupling mechanism 1000 can increase the durability of the club head 100 having the coupling mechanism 1000. Accordingly, the golf club 10 having the coupling mechanism 1000 can withstand increased impact forces and/or increased number of impacts compared to a similar golf club having a coupling mechanism without a reinforcement member having a height greater than the insert bore depth.

In many embodiments, increased durability of the shaft 110 and coupling mechanism 1000 allows the shaft 110 to be made of a lighter material, while maintaining the durability necessary withstand appropriate impact forces and number of impacts. The golf club 10 having the shaft 110 made of a lighter material can have improved swing weight characteristics and balance points compared to a similar golf club without a reinforcement member having a height greater than the insert bore depth. Further, in many embodiments, increased durability of the shaft 110 and coupling mechanism 1000 allows the shaft 110 to be made with thinner walls, while maintaining the durability necessary withstand appropriate impact forces and number of impacts. The golf club 10 having the shaft 110 with reduced wall thickness can improve swing weight characteristics and balance points compared to a similar golf club without a reinforcement member having a height greater than the insert bore depth. Accordingly, the golf club 10 having the coupling mechanism 1000 can have improved swing weight characteristics and balance points compared to a similar golf club without a reinforcement member having a height greater than the insert bore depth.

In many embodiments, using a lighter weight material and/or reducing the wall thickness of the shaft 110 results in reduced shaft weight or mass. Reduced shaft weight can improve mass distribution characteristics (e.g. swing weight) of the golf club 10 by allowing increased discretionary weight to be positioned on the club head 100 or grip of the golf club 10, while maintaining the same overall golf club weight. Increased discretionary weight positioned on the club head 100 can be used to optimize club head CG position. For example, increased discretionary weight positioned on the club head 100 can be used to increase head CG depth 186 and/or head CG height 190. Increased discretionary weight positioned on the club head 100 can further be used to increase the moment of inertia about the x-axis 200, the moment of inertia about the y-axis 210, and/or the moment of inertia about the z-axis 220 to improve club head forgiveness. Further, increased discretionary weight positioned on the club head 100 can increase golf club momentum during a swing and on impact with a golf ball to increase energy transfer to the golf ball resulting in increased ball speed and travel distance.

In many embodiments, reduced insert bore depth 1130 of the coupling mechanism 1000 (e.g. 1000B) can reduce weight or prevent an increase in the weight of the coupling mechanism 1000 compared to a coupling mechanism without a reinforcement member, while maintaining or increasing contact surface area and/or bonding area and therefore strength of the coupling mechanism 1000.

For example, in many embodiments, the weight of the coupling mechanism 1000 can be between 3.0-4.5 grams, 3.0-4.0 grams, 3.5-4.5 grams, or 3.5-4.0 grams. Further, in many embodiments, the weight of the coupling mechanism 1000 can be less than 4.5 grams, less than 4.4 grams, less than 4.3 grams, less than 4.2 grams, less than 4.1 grams, less than 4.0 grams, less than 3.9 grams, less than 3.8 grams, less than 3.7 grams, less than 3.6 grams, less than 3.5 grams, less than 3.4 grams, less than 3.3 grams, less than 3.2 grams, less than 3.1 grams, or less than 3.0 grams.

In many embodiments, reduced weight of the coupling mechanism 1000 can improve swing weight characteristics and balance points of the golf club 10 compared to a similar golf club without a reinforcement member having a height greater than the insert bore depth 1130. Further, in many embodiments, reduced weight of the coupling mechanism 1000 can improve mass distribution characteristics (e.g. swing weight) of the golf club 10 by allowing increased discretionary weight to be positioned on the club head 100 or grip of the golf club 10, while maintaining the same overall golf club weight. Increased discretionary weight positioned on the club head 100 can be used to optimize club head CG position. For example, increased discretionary weight positioned on the club head 100 can be used to increase head CG depth 186 and/or head CG height 190. Increased discretionary weight positioned on the club head 100 can further be used to increase the moment of inertia about the x-axis 200, the moment of inertia about the y-axis 210, and/or the moment of inertia about the z-axis 220 to improve club head forgiveness. Further, increased discretionary weight positioned on the club head 100 can increase golf club momentum during a swing and on impact with a golf ball to increase energy transfer to the golf ball resulting in increased ball speed and travel distance.

In many embodiments, the reinforcement member 1120 further provides increased vibration damping of the coupling mechanism 1000 compared to a similar coupling mechanism without a reinforcement member having a height greater than the insert bore depth. In many embodiments, increased vibration damping can provide a better sound and feel to a user on impact with a golf ball.

Figure 5:
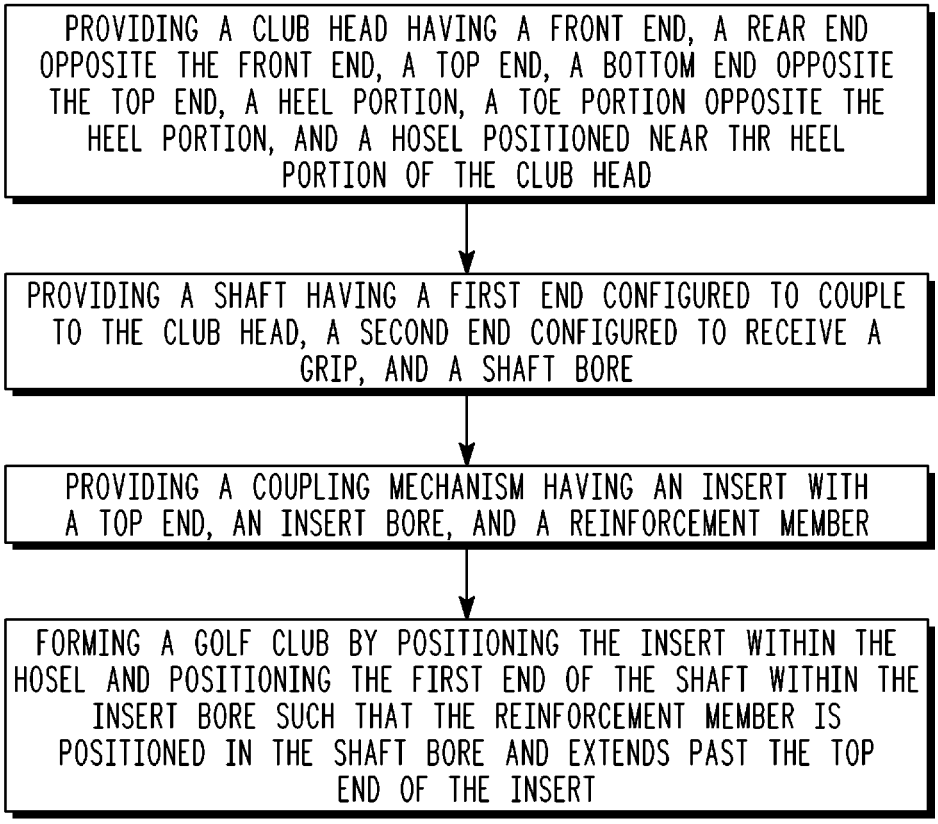
FIG. 5 illustrates a method of manufacturing a golf club head according to an embodiment.

FIG. 5 illustrates a method of manufacturing the golf club. The method includes providing a club head 100 having a front end 104, a rear end 112 opposite the front end 104, a top end 116, a bottom end 120 opposite the top end 116, a heel portion 124, and a toe portion 128 opposite the heel portion 124, and a hosel 140 positioned near the heel portion 124 of the club head 100, providing a shaft 110 having a first end 160 configured to couple to the club head 100, a second end configured to receive a grip, and an shaft bore 164, providing a coupling mechanism 1000 having an insert 1100 with a top end 1104, an insert bore 1124, and a reinforcement member 1120, forming a golf club 10 by positioning the insert 1100 within the hosel 140 and positioning the first end 160 of the shaft 110 within the insert bore 1124 such that the reinforcement member 1120 is positioned in the shaft bore 164 and extends past the top end 1104 of the insert 1100.

Clause 1: A golf club comprising a shaft having a shaft bore and a first end, and a club head having a coupling mechanism, the coupling mechanism including a hosel, an insert configured to be positioned within the hosel, the insert including a top end, a bottom end, an insert bore configured to receive the first end of the shaft, the insert bore having a bottom surface and an insert bore depth measured from the bottom surface to the top end of the insert, and a reinforcement member integrally coupled to and extending from the bottom surface of the insert bore, the reinforcement member configured to be positioned within the shaft bore to reinforce the coupling mechanism, the reinforcement member including a height measured from the bottom surface of the bore to a top end of the reinforcement member, the height of the reinforcement member is greater than 1.25 times the bore depth a contact surface area between the insert and the shaft, the contact surface area is greater than 1.0 $in^2$, wherein the insert is made of a material having a specific gravity greater than 2.0.

Clause 2: The golf club of clause 1, wherein the height of the reinforcement member is greater than 1.5 times the bore depth.

Clause 3: The golf club of clause 1, wherein the height of the reinforcement member is greater than 2.0 times the bore depth.

Clause 4: The golf club of clause 1, wherein the contact surface area between the insert and the shaft is greater than 1.25 $in^2$.

Clause 5: The golf club of clause 1, wherein the contact surface area between the insert and the shaft is greater than 1.75 $in^2$.

Clause 6: The golf club of clause 1, wherein the contact surface area between the insert and the shaft is greater than 2.25 $in^2$.

Clause 7: The golf club of clause 1, wherein the insert is made of a material having a specific gravity greater than 2.5.

Clause 8: The golf club of clause 1, wherein the insert is made of a material having a specific gravity greater than 3.0

Clause 9: The golf club of clause 1, wherein the insert bore depth ranges from 0.25-1.0 inches.

Clause 10: The golf club of clause 1, wherein the height of the reinforcement member ranges from 0.5-2.5 inches.

Clause 11: A method of manufacturing a golf club comprising: providing a shaft having a shaft bore and a first end, proving a club head having a coupling mechanism, the coupling mechanism including a hosel, an insert configured to be positioned within the hosel, the insert including a top end, a bottom end, an insert bore configured to receive the first end of the shaft, the insert bore having a bottom surface and an insert bore depth measured from the bottom surface to the top end of the insert, and a reinforcement member integrally coupled to and extending from the bottom surface of the insert bore, the reinforcement member configured to be positioned within the shaft bore to reinforce the coupling mechanism, the reinforcement member including a height measured from the bottom surface of the bore to a top end of the reinforcement member, the height of the reinforcement member is greater than 1.25 times the bore depth a contact surface area between the insert and the shaft, the contact surface area is greater than 1.0 $in^2$, wherein the insert is made of a material having a specific gravity greater than 2.0, and forming the golf club by positioning the insert within the hosel and positioning the first end of the shaft within the insert bore such that the reinforcement member is positioned in the shaft bore and extends past the top end of the insert Clause 12: The method of clause 11, wherein the height of the reinforcement member is greater than 1.5 times the bore depth.

Clause 13: The method of clause 11, wherein the height of the reinforcement member is greater than 2.0 times the bore depth.

Clause 14: The method of clause 11, wherein the contact surface area between the insert and the shaft is greater than 1.25 $in^2$.

Clause 15: The method of clause 11, wherein the contact surface area between the insert and the shaft is greater than 1.75 $in^2$.

Clause 16: The method of clause 11, wherein the contact surface area between the insert and the shaft is greater than 2.25 $in^2$.

Clause 17: The method of clause 11, wherein the insert is made of a material having a specific gravity greater than 2.5.

Clause 18: The method of clause 11, wherein the insert is made of a material having a specific gravity greater than 3.0.

Clause 19: The method of clause 11, wherein the insert bore depth ranges from 0.25-1.0 inches Clause 20: The method of clause 11, wherein the height of the reinforcement member ranges from 0.5-2.5 inches.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

While the above examples may be described in connection with a driver-type golf club, the apparatus, methods, and articles of manufacture described herein may be applicable to other types of golf club such as a fairway wood-type golf club, a hybrid-type golf club, an iron-type golf club, a wedge-type golf club, or a putter-type golf club. Alternatively, the apparatus, methods, and articles of manufacture described herein may be applicable other type of sports equipment such as a hockey stick, a tennis racket, a fishing pole, a ski pole, etc.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

Various features and advantages of the disclosure are set forth in the following claims.

The invention claimed is:

1. A golf club comprising:

a single shaft having a shaft bore, a first end; and a second end configured to receive a grip, and wherein the single shaft has a shaft outer surface and the shaft bore is encompassed by a shaft inner surface, a club head having a coupling mechanism, the coupling mechanism including a hosel, and an insert configured to be positioned and permanently fastened with an adhesive within the hosel, the insert including a top end, a bottom end, the insert further defining an insert bore configured to receive the first end of the single shaft, the insert bore having a bottom surface, an inner surface, and an insert bore depth measured from the bottom surface to the top end of the insert, and wherein the insert bore depth ranges from 0.25-1.0 inches;

the insert further including a reinforcement member, wherein the reinforcement member is integrally formed with and comprises the same material as the insert such that the insert consists of a single piece, the reinforcement member configured to be positioned within the shaft bore to reinforce the coupling mechanism, wherein a top end of the reinforcement member is exposed to the shaft bore, the reinforcement member including a height measured from the bottom surface of the bore to a top end of the reinforcement member, the height of the reinforcement member greater than 1.25 times the bore depth, wherein the height of the reinforcement member ranges from 0.5-2.5 inches, wherein the reinforcement member has a substantially circular cross-sectional shape having a constant diameter, and a contact surface area between the insert and the single shaft, wherein the contact surface area consists of the sum of area of contact between the inner surface of the insert bore and the outer surface of the single shaft, the area of contact between the bottom surface of the insert bore and the first end of the shaft, and the area of contact between the reinforcement member and the inner surface of the shaft, wherein the contact surface area is greater than 1.0 $in^2$, wherein the insert is made of a material having a specific gravity greater than 2.0.

2. The golf club of claim 1, wherein the height of the reinforcement member is greater than 1.5 times the bore depth.

3. The golf club of claim 1, wherein the height of the reinforcement member is greater than 2.0 times the bore depth.

4. The golf club of claim 1, wherein the contact surface area between the insert and the single shaft is greater than 1.25 $in^2$.

5. The golf club of claim 1, wherein the contact surface area between the insert and the single shaft is greater than 1.75 $in^2$.

6. The golf club of claim 1, wherein the contact surface area between the insert and the single shaft is greater than 2.25 $in^2$.

7. The golf club of claim 1, wherein the insert is made of a material having a specific gravity greater than 2.5.

8. The golf club of claim 1, wherein the insert is made of a material having a specific gravity greater than 3.0.

9. The golf club of claim 1, wherein the insert bore depth ranges from 0.25-1.0 inches.

10. A method of manufacturing a golf club comprising:

providing a single shaft having a shaft bore and a first end, and a second end configured to receive a grip, wherein the single shaft has a shaft outer surface and the shaft bore is encompassed by a shaft inner surface, providing a club head having a coupling mechanism, the coupling mechanism including a hosel, and an insert configured to be positioned and permanently fastened with an adhesive within the hosel, the insert including a top end, a bottom end, the insert further defining an insert bore configured to receive the first end of the single shaft, the insert bore having a bottom surface, an inner surface, and an insert bore depth measured from the bottom surface to the top end of the insert, wherein the insert bore depth ranges from 0.25-1.0 inches; and the insert further including a reinforcement member, wherein the reinforcement member is integrally formed with and comprises the same material as the insert such that the insert consists of a single piece, the reinforcement member configured to be positioned within the shaft bore to reinforce the coupling mechanism, the reinforcement member including wherein a top end of the reinforcement member is exposed to the shaft bore, a height measured from the bottom surface of the bore to a top end of the reinforcement member, the height of the reinforcement member greater than 1.25 times the bore depth, wherein the height of the reinforcement member ranges from 0.5-2.5 inches, wherein the reinforcement member has a substantially circular cross-sectional shape having a constant diameter, and a contact surface area between the insert and the single shaft, wherein the contact surface area consists of the sum of area of contact between the inner surface of the insert bore and the outer surface of the single shaft, the area of contact between the bottom surface of the insert bore and the first end of the shaft, and the area of contact between the reinforcement member and the inner surface of the shaft, wherein the contact surface area is greater than 1.0 $in^2$, wherein the insert is made of a material having a specific gravity greater than 2.0; and forming the golf club by positioning the insert within the hosel and positioning the first end of the single shaft within the insert bore such that the reinforcement member is positioned in the shaft bore and extends past the top end of the insert.

11. The method of claim 10, wherein the height of the reinforcement member is greater than 1.5 times the bore depth.

12. The method of claim 10, wherein the height of the reinforcement member is greater than 2.0 times the bore depth.

13. The method of claim 10, wherein the contact surface area between the insert and the single shaft is greater than 1.25 $in^2$.

14. The method of claim 10, wherein the contact surface area between the insert and the single shaft is greater than 1.75 $in^2$.

15. The method of claim 10, wherein the contact surface area between the insert and the single shaft is greater than 2.25 $in^2$.

16. The method of claim 10, wherein the insert is made of a material having a specific gravity greater than 2.5.

17. The method of claim 10, wherein the insert is made of a material having a specific gravity greater than 3.0.

18. The method of claim 10, wherein the insert bore depth ranges from 0.25-1.0 inches.

* * * * *